US008596196B2

(12) United States Patent
Shih

(10) Patent No.: US 8,596,196 B2
(45) Date of Patent: Dec. 3, 2013

(54) ADJUSTMENT WHEEL ASSEMBLY OF AN ADJUSTABLE STAMP

(75) Inventor: Hsu-Shen Shih, Tainan (TW)

(73) Assignee: Sun Same Enterprises Co., Ltd., Tainan (TW)

( * ) Notice: Subject to any disclaimer, the term of this patent is extended or adjusted under 35 U.S.C. 154(b) by 181 days.

(21) Appl. No.: 13/193,772

(22) Filed: Jul. 29, 2011

(65) Prior Publication Data

US 2013/0025480 A1 Jan. 31, 2013

(51) Int. Cl.
*B31F 1/07* (2006.01)
*B41J 1/60* (2006.01)

(52) U.S. Cl.
USPC ..... 101/9; 101/10; 101/111

(58) Field of Classification Search
USPC ..... 101/9, 10, 4, 5, 109–111
See application file for complete search history.

(56) References Cited

U.S. PATENT DOCUMENTS

| | | | | |
|---|---|---|---|---|
| 5,295,602 | A * | 3/1994 | Swanson | 220/786 |
| 5,575,399 | A * | 11/1996 | Intini | 220/835 |
| 5,860,543 | A * | 1/1999 | Decelles | 215/209 |
| 6,536,447 | B1 * | 3/2003 | Fioravanti et al. | 132/299 |
| 6,752,448 | B1 * | 6/2004 | Hsu | 296/97.22 |
| 7,410,073 | B2 * | 8/2008 | Yuhara | 220/212 |
| 7,469,787 | B2 * | 12/2008 | Yuhara | 206/581 |
| 2005/0172981 | A1 * | 8/2005 | Byun | 132/287 |
| 2007/0067996 | A1 * | 3/2007 | Chang | 30/90.1 |
| 2009/0147469 | A1 * | 6/2009 | Chen et al. | 361/679.55 |

* cited by examiner

*Primary Examiner* — Ren Yan
*Assistant Examiner* — David Banh
(74) *Attorney, Agent, or Firm* — Ming Chow; Sinorica, LLC

(57) ABSTRACT

An adjustment wheel assembly of an adjustable stamp, mounted on an adjustment wheel unit of the adjustable stamp, has a printing type cover combined with a torsion spring and pivotally mounted on the adjustable wheel unit, and a fastener mounted on the adjustment wheel unit. The printing type cover has a tab and a snap part formed on another side of the printing type cover to engage the fastener and disengage the fastener when a pressing part of the fastener is pressed. The torsion spring enables the printing type cover to flip up. The printing type cover is closed and fixed by pressing down the tab formed on an edge portion of the printing type cover. Accordingly, users' fingers can be prevented from being stained upon flipping up and closing the printing type cover.

4 Claims, 7 Drawing Sheets

ADJUSTMENT WHEEL ASSEMBLY OF AN ADJUSTABLE STAMP

BACKGROUND OF THE INVENTION

1. Field of the Invention

The present invention is related to an adjustable wheel assembly of an adjustable stamp, and more particularly to an adjustable wheel assembly having a flip-up printing type cover unit facilitating adjusting printing types without staining a user's fingers.

2. Description of the Related Art

Existing adjustable stamp has an inner housing sleeved by an outer housing. A torsion spring is mounted in the outer housing and abuts against a top portion of the inner housing. An ink unit and an adjustment wheel unit are assembled within the inner housing. The ink unit has a wheel base and a plurality of wheels mounted in the wheel base. A printing belt having a plurality of printing types is mounted on each wheel. Two actuating rods are respectively inserted in two limit slots on both sides of the inner housing and are respectively inserted in two guide holes on both sides of the outer housing. A printing type cover is mounted on the wheel base. A rubber printing plate for producing permanent imprint is attached on the printing type cover by adhesive. The plurality of printing types penetrates through the printing type cover and is integrated with the rubber printing plate. The outer housing is pressed to drive the adjustment wheel unit to moisten with ink and imprint.

The printing type cover of the existing adjustable stamp can be directly disassembled and assembled. When adjusting the printing types, the printing type cover needs to be removed first, and then the printing types are adjusted. After the adjustment, the printing type cover is assembled back on the wheel base. However, when disassembling and assembling the printing type cover, users' fingers are easily stained with the ink.

To resolve the issue that user's fingers are stained by ink when disassembling the printing type cover, a flip-up printing type cover is developed. With reference to FIGS. 6 and 7, an adjustable stamp having a flip-up printing type cover has an inner housing 60, an outer housing 61, a torsion spring (not shown), an ink unit 62, an adjustment wheel unit 63 and a printing type cover 64. The outer housing 61 is sleeved on the inner housing 60. The torsion spring abuts against a top portion of the inner housing 60. The ink unit 62 and the adjustment wheel unit 63 are mounted in the inner housing 60. The adjustment wheel unit 63 has a wheel base 631, a plurality of wheels 632 and two actuating rods 633. The wheel base 631 has a hook 634 mounted on a top portion of a periphery of the wheel base 631. The plurality of wheels 632 is mounted in the wheel base 631. The two actuating rods 633 are respectively mounted through two limit slots 601 oppositely formed through a top rim of the inner housing 60, and respectively inserted in two guide slots 611 and respectively and oppositely formed through two top portions of the outer housing 61. The printing type cover 64 has a pivotal edge, a flip-up edge, a tab 642, a printing plate attaching area 643 and a rubber printing plate (not shown). The pivotal edge is pivotally mounted on the wheel base 631. The flip-up edge has a fastening part 641. The tab 642 is formed on and protrudes from the flip-up edge. The fastening part 641 engages the hook 634 when the printing type cover 64 is closed. The rubber printing plate is bonded to the printing plate attaching area 643 by adhesive for producing permanent imprint.

When flipping up the printing type cover 64 to use the adjustable stamp, users need to push against the tab 642 of the printing type cover 64 so as to disengage the fastening part 641 from the hook 634. However, users are still troubled with inadvertent contact with ink on the rubber printing plate from time to time during the flip-up process.

SUMMARY OF THE INVENTION

An objective of the present invention is to provide an adjustable wheel assembly of an adjustable stamp having a flip-up printing type cover unit facilitating adjusting printing types without staining user's fingers.

To achieve the foregoing objective, the adjustable wheel assembly of the adjustable stamp has an adjustment wheel unit and a flip-up printing type cover unit.

The flip-up printing type cover unit is mounted on the adjustment wheel unit, and has a printing type cover combined with a torsion spring and pivotally mounted on the adjustable wheel unit, and a fastener mounted on the adjustment wheel unit. The printing type cover has a tab and a snap part formed on another side of the printing type cover to engage the fastener and disengage the fastener when a pressing part of the fastener is pressed. The torsion spring enables the printing type cover to flip up. The printing type cover is closed and fixed by pressing down the tab formed on an edge portion of the printing type cover. Accordingly, users' fingers can be prevented from being stained upon flipping up and closing the printing type cover.

DETAILED DESCRIPTION OF THE INVENTION

Figure 1:
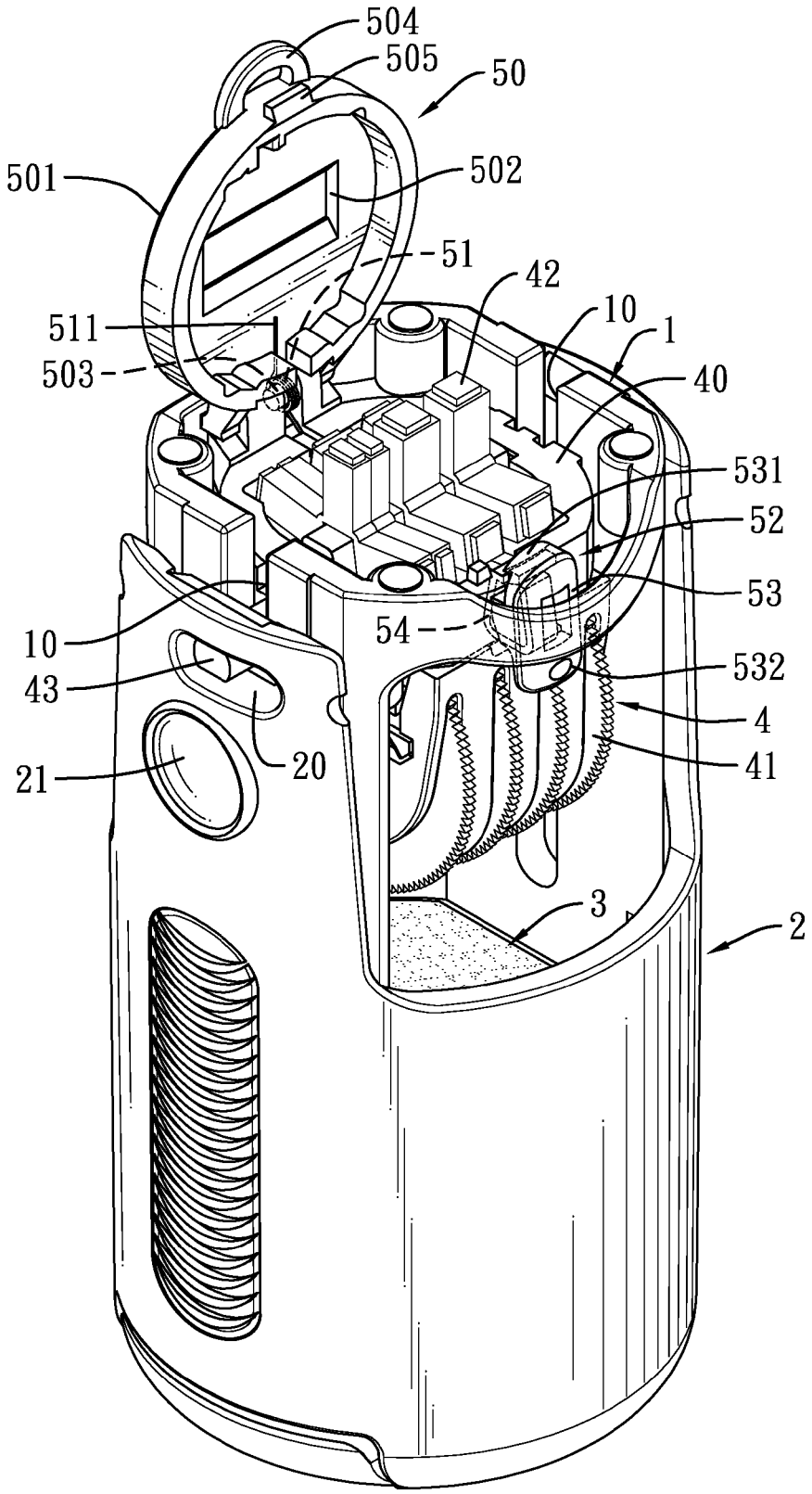
FIG. 1 is a perspective view of a first embodiment of an adjustable stamp in accordance with the present invention.
Figure 2:
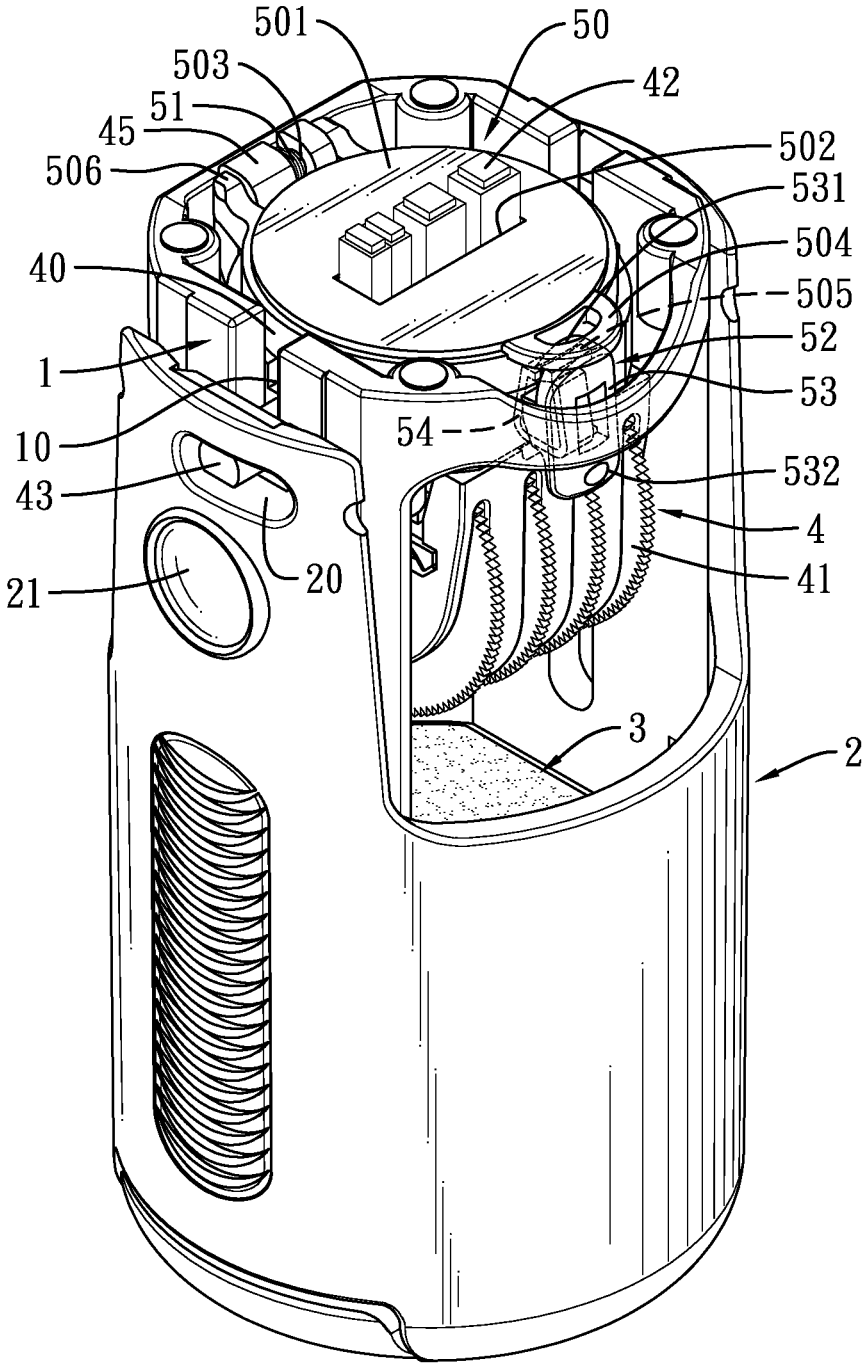
FIG. 2 is another perspective view of the adjustable stamp in FIG. 1.
Figure 3:
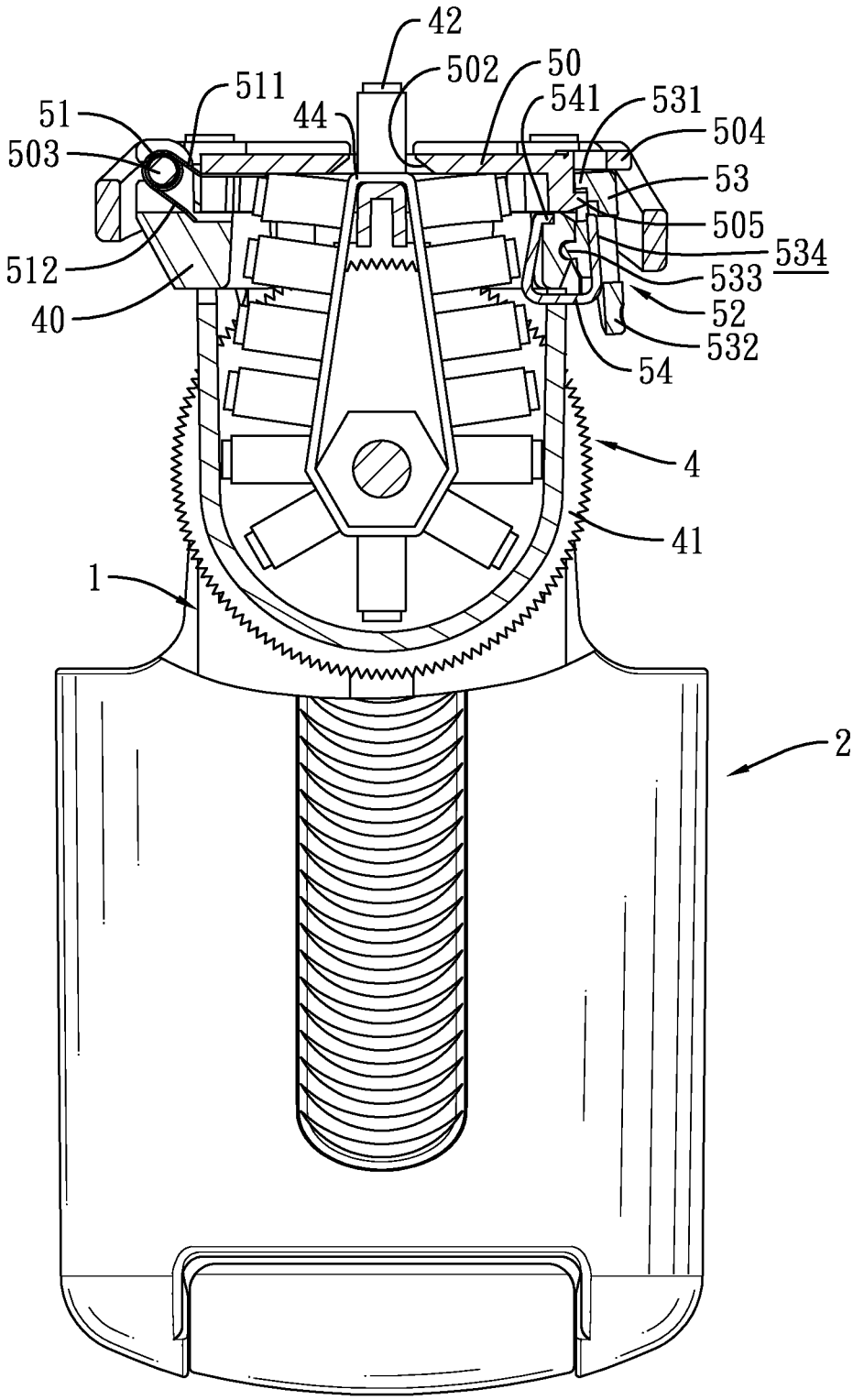
FIG. 3 is a side view in partial section of the adjustable stamp in FIG. 1.

With reference to FIGS. 1 to 3, a first embodiment of an adjustable stamp in accordance with the present invention has an inner housing 1, an outer housing 2, a torsion spring (not shown), an ink unit 3 and an adjustable wheel assembly. The outer housing 2 is sleeved on the inner housing 1. The torsion spring is mounted inside the outer housing 2 and between the inner housing 1 and the outer housing 2. The ink unit 3 is mounted at a lower portion inside the inner housing 1.

The adjustable wheel assembly is mounted inside the inner housing 1 and has an adjustment wheel unit 4 and a flip-up printing type cover unit. The adjustment wheel unit 4 is mounted at an upper portion inside the inner housing 1 and is located above the ink unit 3. The adjustment wheel unit 4 has a wheel base 40, multiple wheels 41 and a first pivotal part 45. The wheel base 40 is pivotally mounted on two opposite sides of the outer housing 2. The plurality of wheels 41 is parallelly and pivotally mounted in the wheel base 40. Each wheel 41 is turned by users' finger to drive a belt 44 mounted around a pivot shaft of the wheel 41 and an upper position. The belt 44 has a plurality of printing types 42 formed thereon and selected by turning the corresponding wheel 41 upwardly or downwardly. The first pivotal part 45 is formed on a top edge of the wheel base 40.

The flip-up printing type cover unit is mounted on the wheel base 40 and has a printing type cover 50, a torsion spring 51 and a fastener 52.

The printing type cover 50 has a printing type holder 501, a through slot 502, a second pivotal part 506, a tab 504 and a snap part 505. The through slot 502 is formed through the printing type holder 501 and aligns with the printing types 42. The second pivotal part 506 is formed on one edge portion of the printing type holder 501 and pivotally mounted to the first pivotal part 45 of the adjustment wheel unit 4 through a pivotal shaft 503. The tab 504 and the snap part 505 are formed on another edge portion of the printing type holder 501.

The torsion spring 51 is mounted around the pivot shaft 503 and has two urging ends 511, 512 respectively urging against the printing type cover 50 and the wheel base 40 to provide elastic force required to open the printing type cover 50.

The fastener 52 has an engagement piece 53 and a resilient piece 54. The engagement piece 53 has an engagement part 531, a pressing part 532, an urging part 533 and a fixing cavity 534. The engagement part 531 is formed on a top end of the engagement piece 53 and the pressing part 532 is formed on a bottom end of the engagement piece 53 so that the engagement part 531 can engage the snap part 505 of the printing type cover 50 and the engagement part 531 can disengage from the snap part 505 when the pressing part 532 is pressed. The urging part 533 is formed on a central portion of the engagement piece 53 to abut against a side of the wheel base 40. The fixing cavity 534 is formed through a side of the urging part 533. The resilient piece 54 takes a U-shaped form. One end of the resilient piece 54 engages the wheel base 40. The other end is mounted through and fixed in the fixing cavity 534 of the engagement piece 53, and is located above the urging part 533 so that the resilient piece 54 can be securely connected between the wheel base 40 and the engagement piece 53. Given the elastic force of the resilient piece 54, when the pressing part 532 of the engagement piece 53 is pressed, the engagement part 531 can disengage from the snap part 505. The resilient piece 54 has a hook 541 formed on and protruding from the end of the resilient piece 54 that engages the wheel base 40 for engaging a recess formed in the wheel base 40.

When the flip-up printing type cover unit is applied to the adjustable stamp, a rubber printing plate is attached on the printing type holder 501 of the printing type cover 50 to provide a permanent pattern of imprinting. After the printing type cover 50 is closed on the wheel base 40 and is fixed by the fastener 52, the permanent pattern of the rubber printing plate is combined with the adjustable pattern formed by the selected printing types 42 of the adjustment wheel unit 4 to generate a complete pattern for imprinting. When the outer housing 2 is held and pressed down to imprint, the outer housing 2 drives the adjustable wheel unit 4 to descend and rotate inside the inner housing 1 so as to imprint the complete pattern formed by the rubber printing plate and the selected printing types 42. After the outer housing 2 is lifted up, the outer housing 2 is propped up by the torsion spring to drive the adjustment wheel unit 4 to ascend and reversely rotate inside the inner housing 1 so as to moisten the rubber printing plate and the selected printing types 42 with ink for subsequent imprint.

When the printing types 42 of the adjustment wheel unit 4 is intended for adjustment, the outer housing 2 is pressed down to a pre-defined position. The buttons 21 on two sides of the outer housing 2 are pressed to lock the outer housing 2 at the pre-defined position, and the printing type cover 50 attached with the rubber printing plate faces up and is positioned at a top end of the inner housing 1. The pressing part 532 of the fastener 53 is pressed and the engagement part 531 disengages from the snap part 505 of the printing type cover 50. Given the elastic force of the torsion spring 51, the printing type cover 50 is flipped up. Users can turn a corresponding wheel 41 to select a printing type. After selection of the desired printing types 42 is completed, the printing type cover 50 is restored to close and the tab 504 of the printing type cover 50 is pressed so that the snap part 505 of the printing type cover 50 engages and is fixed in the fastener 53 to complete the adjustment of the printing types 42. Accordingly, when opening and closing the printing type cover 50, users can be prevented from contacting the rubber printing plate on the printing type cover 50, thereby reducing the chance of being stained by ink.

Figure 4:
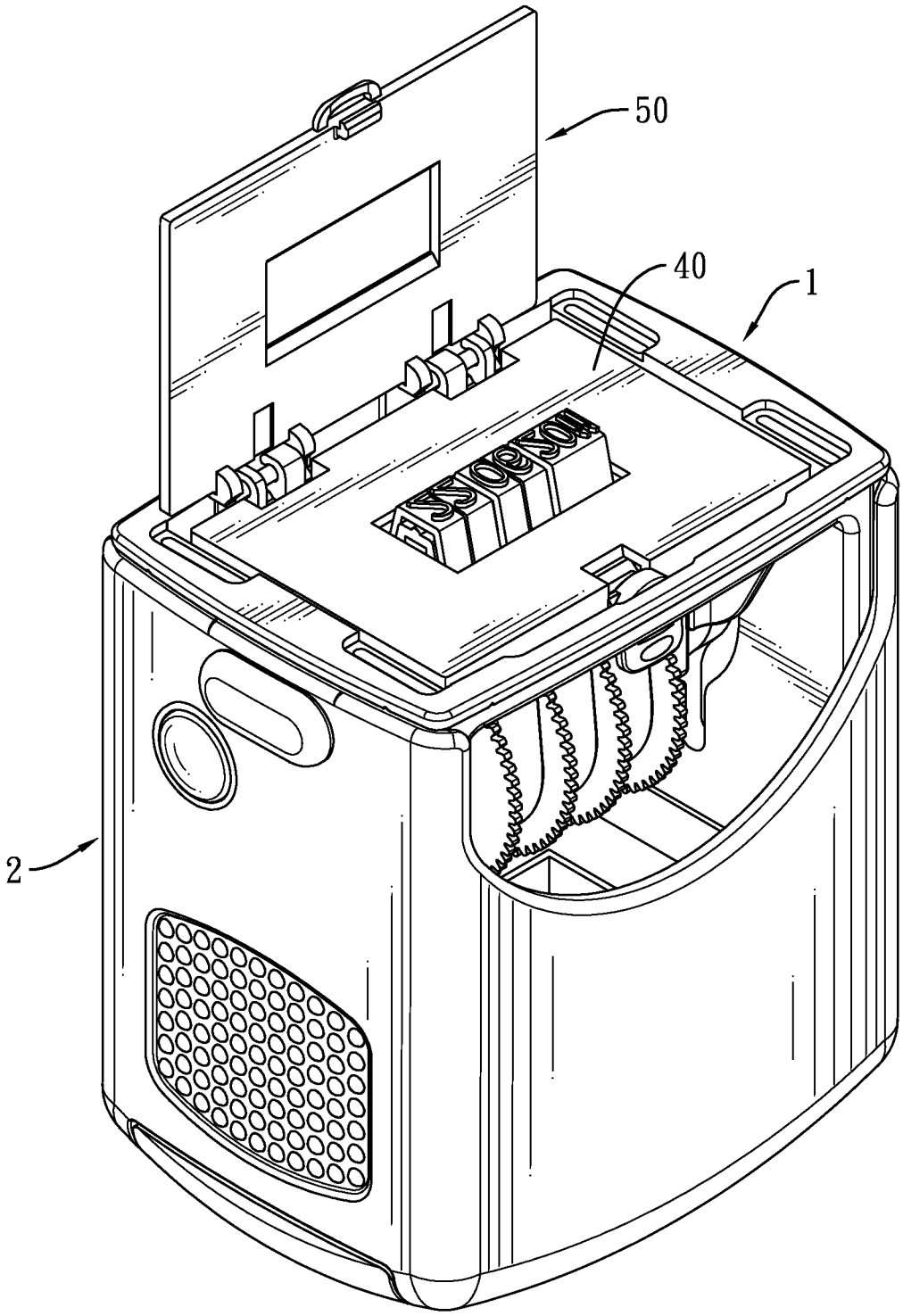
FIG. 4 is a perspective view of a second embodiment of an adjustable stamp in accordance with the present invention.
Figure 5:
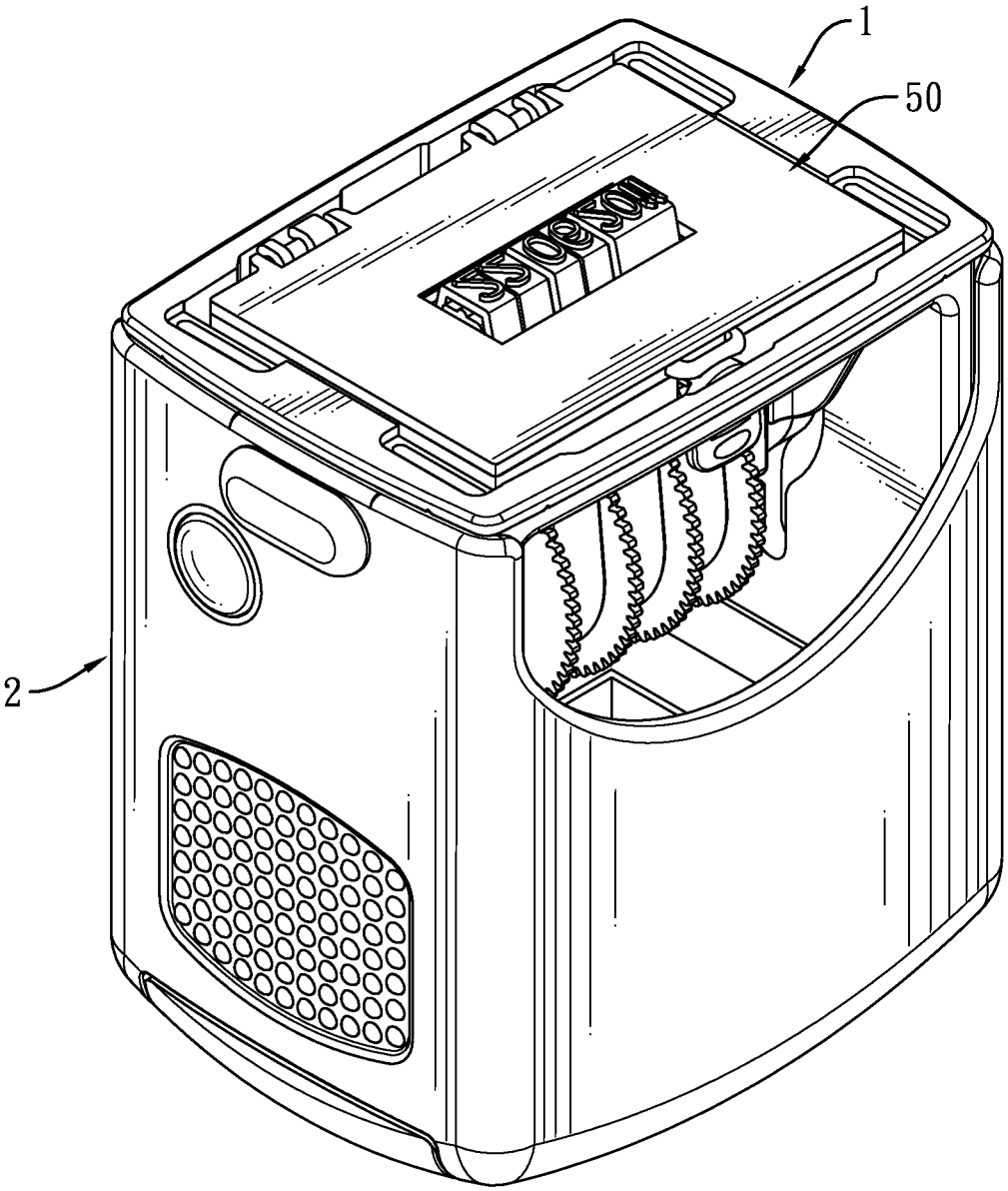
FIG. 5 is another perspective view of the adjustable stamp in FIG. 4.
Figure 6:
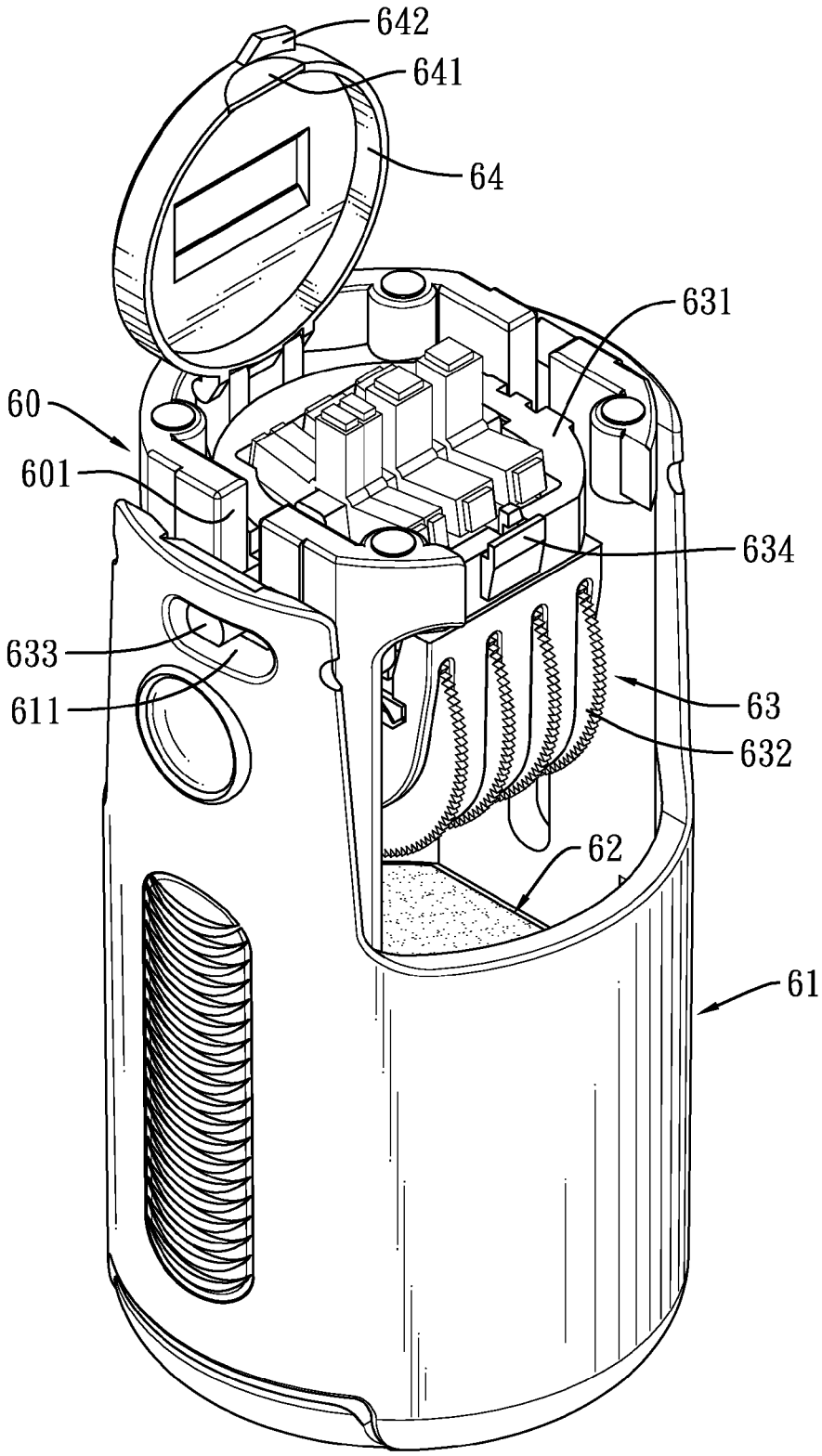
FIG. 6 PRIOR ART
FIG. 6 is a perspective view of a conventional adjustable wheel assembly of an adjustable stamp.
Figure 7:
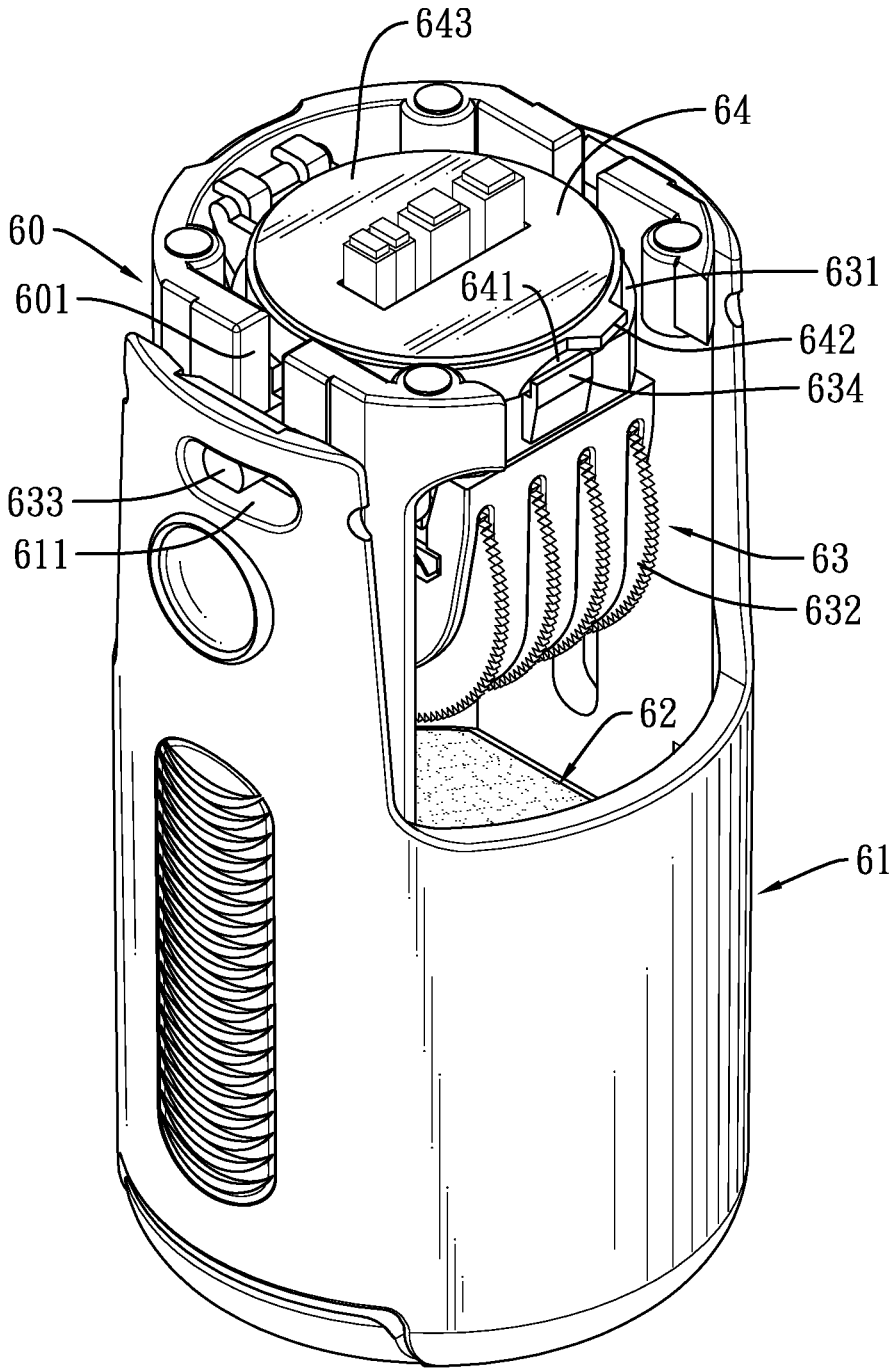
FIG. 7 PRIOR ART
FIG. 7 is another perspective view of the conventional adjustable wheel assembly of the adjustable stamp in FIG. 6.

With reference to FIGS. 4 and 5, a second embodiment of an adjustable stamp in accordance with the present invention differs from the first embodiment in the shapes thereof and the pivoting means of the printing type cover. The adjustable stamp in the first embodiment is a cylindrical stamp so that the inner housing 1, the outer housing 2, the wheel base 40 are cylindrical and the printing type cover 50 is circular in shape while the adjustable stamp in the second embodiment is a rectangular stamp so that the inner housing 1', the outer housing 2', the wheel base 40' are cuboid and the printing type cover 50 is rectangular in shape. As to the pivoting means of the printing type cover 50, the printing type cover 50 in the first embodiment is pivotally mounted on one position of the inner housing 2 while the printing type cover 50' of the second embodiment is pivotally mounted on two positions of the inner housing 2'.

What is claimed is:

1. An adjustment wheel assembly of an adjustable stamp, comprising:

an adjustment wheel unit having:

a wheel base;

multiple wheels parallelly and pivotally mounted in the wheel base;

multiple printing types driven by the wheels; and a first pivotal part formed on a top edge of the wheel base; and a flip-up printing type cover unit pivotally connected to the wheel base of the adjustment wheel unit and having:

a printing type cover covering the wheel base and having:

a printing type holder;

a through slot formed through the printing type holder and aligned to the printing types;

a second pivotal part formed on one edge portion of the printing type holder and pivotally mounted to the first pivotal part of the adjustment wheel unit through a pivot shaft;

a tab formed on another edge portion of the printing type holder; and a snap part formed on the edge portion on which the tab is formed;

a torsion spring mounted on the pivot shaft and having two urging ends respectively urging against the printing type cover and the wheel base of the adjustment wheel unit; and a fastener having:

a resilient piece taking a U-shaped form, and mounted on an outside of the wheel base of the adjustment wheel unit with one end of the resilient piece engaging the adjustment wheel unit; and an engagement piece mounted to the resilient piece with the other end of the resilient piece mounted through and fixed in a central portion of the engagement piece as so to be moveable relative to the wheel base of the adjustment wheel unit, and having an urging part formed on the central portion of the engagement piece and adapted to abut against a side of the adjustment wheel unit;

an engagement part formed on a top end of the engagement piece and corresponding to the snap part of the printing type cover; and a pressing part formed on a bottom end of the engagement piece to control the engagement part to engage the snap part of the printing type cover or disengage from the snap part when the pressing part is pressed.

2. The adjustment wheel assembly of the adjustable stamp as claimed in claim 1, wherein a fixing cavity is formed through a side of the urging part for the resilient piece to be mounted through and fixed in the fixing cavity.

3. The adjustment wheel assembly of the adjustable stamp as claimed in claim 1, wherein the resilient piece has a hook formed on and protruding from the end of the resilient piece that engages the adjustment wheel unit to engage a recess formed in the wheel base.

4. The adjustment wheel assembly of the adjustable stamp as claimed in claim 2, wherein the resilient piece has a hook formed on and protruding from the end of the resilient piece that engages the adjustment wheel unit to engage a recess formed in the wheel base.

* * * * *